US005527041A

United States Patent [19]

Terry, III et al.

[11] Patent Number: 5,527,041

[45] Date of Patent: Jun. 18, 1996

[54] GOLF PUTTING TRAINER

[76] Inventors: J. Stanford Terry, III, 4590 Osage Dr., Boulder, Colo. 80303; David K. Woods, 102 Rosebud Ct., Greer, S.C. 29650

[21] Appl. No.: 426,049

[22] Filed: Apr. 21, 1995

[51] Int. Cl.[6] ..... A63B 69/36

[52] U.S. Cl. ..... 473/150; 473/220; 473/260; 473/265; 473/268

[58] Field of Search ..... 273/DIG. 30, 192, 273/191 R, 186.3, 186.1; 434/252

[56] References Cited

U.S. PATENT DOCUMENTS

| | | | |
|---|---|---|---|
| 3,899,180 | 8/1975 | Rodman | 273/192 X |
| 4,230,319 | 10/1980 | Lindner | 273/192 |
| 4,315,626 | 2/1982 | Hamm | 273/192 X |
| 4,453,717 | 6/1984 | Solheim et al. | 273/192 |
| 4,516,779 | 5/1985 | Miller | 273/192 X |
| 4,544,160 | 10/1985 | Miner | 273/192 X |
| 4,620,708 | 11/1986 | Meyer et al. | 273/192 |
| 4,765,625 | 8/1988 | Miner | 273/195 R |
| 4,826,174 | 5/1989 | Hoyt, Jr. | 273/192 X |
| 4,828,267 | 5/1989 | Goodrich | 273/176 F |
| 4,911,450 | 3/1990 | Rabold | 273/194 A |
| 4,927,153 | 5/1990 | Schaefer | 273/187 R |
| 4,971,327 | 11/1990 | Rabold | 273/192 X |
| 4,971,328 | 11/1990 | Hernberg | 273/186.1 |
| 4,984,802 | 1/1991 | Barraclough | 273/192 |
| 4,997,189 | 3/1991 | Perkins | 273/192 |
| 5,011,154 | 4/1991 | Bowen | 273/192 |
| 5,029,868 | 7/1991 | Cloud | 273/177 R |
| 5,037,100 | 8/1991 | Montgomery, Sr. | 273/192 X |
| 5,060,952 | 10/1991 | Brill | 273/192 |
| 5,092,602 | 3/1992 | Witler et al. | 273/184 R |
| 5,165,691 | 11/1992 | Cook | 273/186.3 |
| 5,169,150 | 12/1992 | Tindale . | |
| 5,180,168 | 1/1993 | Balestrieri | 273/192 X |
| 5,193,812 | 3/1993 | Hendricksen | 273/186.3 |
| 5,209,484 | 5/1993 | Randall | 273/192 |
| 5,211,400 | 5/1993 | Hall et al. | 273/187.6 |
| 5,213,331 | 5/1993 | Avanzini | 273/186.3 |
| 5,217,228 | 6/1993 | De Aguilar | 273/186.3 |
| 5,246,233 | 9/1993 | Sheltman et al. | 273/186.1 |
| 5,273,284 | 12/1993 | Montgomery | 273/192 X |
| 5,282,627 | 2/1994 | Beck | 273/192 X |
| 5,294,124 | 3/1994 | Florian | 273/186.1 |
| 5,308,070 | 5/1994 | Whittaker | 273/192 X |
| 5,320,335 | 6/1994 | Johnson | 273/192 |
| 5,324,039 | 6/1994 | Reimers et al. | 273/186.1 |
| 5,330,188 | 7/1994 | Reimers | 273/186.1 |
| 5,332,211 | 7/1994 | Rife et al. | 273/187.6 |
| 5,348,304 | 9/1994 | Meade | 273/187.6 |
| 5,350,177 | 9/1994 | Furbush, Jr. | 273/192 X |
| 5,351,962 | 10/1992 | Lin | 273/186.2 |
| 5,374,063 | 12/1994 | Ogden | 273/186.3 |
| 5,375,833 | 12/1994 | Marier, Jr. | 273/186.1 |
| 5,388,831 | 2/1995 | Quadri et al. | 273/186.3 |
| 5,388,832 | 2/1995 | Hsu | 273/186.3 |
| 5,388,833 | 2/1995 | Goyen, Jr. | 273/192 X |
| 5,393,065 | 2/1995 | LeQuyea | 273/192 |
| 5,398,937 | 3/1995 | Regan | 273/DIG. 30 |

*Primary Examiner*—George J. Marlo

*Attorney, Agent, or Firm*—Robert G. Crouch; Chrisman, Bynum & Johnson

[57] ABSTRACT

A golf training device features a support base with a light source attached thereto, the light source generating a planar-shaped beam of light which is projected forward of the support board to form a target line on the ground. The target line can be used in alignment of the golfer's body and club face before and during the striking of the golf ball. A pair of removably attachable elongated guide rails can be attached to the top of the support base to provide a guide path for the golfer to move the club head therethrough while putting a golf ball from the top of the support base. The positions of the guide rails can be selected to accommodate putters having different club head lengths, as well as to provide for lesser-constrained guide paths. The light source includes a laser and a cylindrically-shaped optical element placed transversely to the light beam to create the planar-shaped beam.

19 Claims, 2 Drawing Sheets

GOLF PUTTING TRAINER

This invention relates to a method and apparatus for a golfer to utilize in training or practicing a consistent golf stroke and more particularly the invention relates to a device with a light beam projected therefrom to create a visible intended target path for the stroked golf ball in order to aid in the golfer's alignment and to provide feedback of the relative accuracy of the stroke.

BACKGROUND OF THE INVENTION

Golf is a game which naturally fosters in the golfer a keen desire to improve. As a result, the typical golfer is constantly searching for techniques and methods by which to improve, perfect, or "groove" the desired golf swing or golf stroke.

The physics involved in hitting a golf ball are relatively simple. Ignoring the effects of wind and the behavior of the club head and golf ball at impact, the flight of the golf ball, and hence the distance and accuracy of the golf shot, is primarily controlled by three factors. These factors are the alignment of the club face of the golf club at impact, the direction of movement of the club head of the golf club at impact, and the speed of the club head at impact. This is true for both full-swing golf shots and for the putting stroke which is used to accurately roll the ball across the putting green and into the hole.

Therefore, when putting it is desirable to accurately control the alignment of the club face of the putter and the direction of movement of the club head at the point of impact. Further, because the putting stroke will normally be used on each golf hole played by the golfer, it is particularly desirable to control these factors in a consistent manner, also known as "grooving" the putting stroke.

There are a variety of devices which have been developed to assist the golfer in aligning the golfer's feet and club head as well as devices to help groove the proper swing path. One category of such devices includes those with one or two guide rails placed adjacent to the golf ball. The golfer can stroke the club along the guide rails to practice a straight-back and straight-through putting stroke. Unfortunately, the guide rails are not typically adjustable in their spaced-apart positions from each other. Such adjustment is desirable because golf clubs, particularly putters, come in a variety of differently-sized dub heads. In order to tightly constrain the moving club head to be between the two guide rails, it is necessary to provide adjustability of the positions of the guide rails. A device which does provide adjustable guide rails involves loosening a screw and adjusting a housing relative to another housing and then re-tightening the screw. Such an arrangement is cumbersome and inconvenient.

Other devices which assist the golfer in the alignment of the club head have included laser light sources associated with the golf club and indicating the direction in which the club face is pointed. One drawback of all such devices is the requirement that the golfer cannot use the golfer's own personal putter without modification. Each of the devices either requires a specialized, custom putter incorporating the device or requires a modification or attachment to the golfer's own putter. Such devices do not accommodate the golfer's desire to practice with their own putter in an unmodified fashion. Golf clubs, and particularly putters, come in a variety of lengths, weights, and distributions of weight along the golf club. Further, the shape of the club head provides an aesthetic appearance which may instill confidence in the golfer. All of these factors cause a golfer to become comfortable with their own putter and less likely to use or feel comfortable with a specialized, custom putter or even with their own putter if modified to change the appearance, shape, and/or weight distribution.

A further disadvantage of these devices is the fact that the direction of the light beam projected from the light source is dependent on the directional alignment of the dub face of the putter. Since the putter is held in the hands of the golfer and is moved during the putting stroke, the light beam tends to move dramatically, resulting in a moving light spot which is hard to follow. Further, even when the light spot is stationary and perceptible, it indicates the directional alignment of the club face and not of the desired target path of the golf ball.

In summary, none of these devices provides the desired training environment. Either the devices are inconvenient and cumbersome or they do not provide the desired indications.

SUMMARY OF THE INVENTION

Accordingly, it is an object of the present invention to provide a golf training device which provides a visible indication of the desired target path.

It is another object of this invention to provide a golf training device in which a visible target line is created on the ground forward of the golf ball to be used by the golfer in aligning the golfer's body and club head and in making an accurate stroke to roll the ball therealong.

It is a further object of this invention to provide a golf training device which provides visual feedback to the golfer of the accuracy of the golfer's stroke while the putted ball is rolling along or near the target line or path.

It is still further an object of the present invention to provide a golf training device with means thereon for guiding the club head along the desired target path in order to make an accurate golf putting stroke.

It is another object of the present invention to provide a guiding means which is adjustable to accommodate any one of a variety of differently-sized putters.

To achieve the foregoing and other objects and in accordance with the purposes of the present invention, as embodied and broadly described therein, the present invention is directed to a training device for a golfer to utilize in practicing a stroke of a golf club in order to attempt to accurately hit a golf ball toward a remove target. The device includes a support base for resting on the ground, and a light source associated with the support base. The light source generates a visible beam of light forward of the support board and toward the remote target. In this manner the golfer can appreciate the alignment of the golfer's body and the golf club relative to the remote target by viewing the visible beam of light. The visible beam of light of the device may form a target line on the ground or a target spot on the ground or on a remote vertical object. The target line is accomplished by an optical element which converts the light beam into a vertically-oriented, planar-shape, wherein the line is formed at the intersection of the plane with the ground.

The device may also include a pair of elongated guide rails which are removably attachable to the support base to provide a guide path for the golfer to stroke the golf club along. Further, the device may include a ramp which allows the golf ball to smoothly roll down from the support base to the ground. This ramp can be an elongated, resilient member which can be temporarily deformed under the weight of the golf ball so as to be moved into a position forming the ramp. When the golf bail is no longer on top of the resilient member it returns back to a substantially-horizontal rest position.

The present invention is also directed to a method for practicing the stroke of a golf club in order to attempt to accurately hit a golf ball toward a remote target. The method includes the steps of providing a support base for resting on the ground, projecting a visible light beam forward from a support base and toward a remote target, and stroking the golf bail with the golf club in an attempt to hit the golf bail along the visible beam of light and toward the remote target.

BRIEF DESCRIPTION OF THE DRAWINGS

The accompanying drawings, which are incorporated in and form a part of the specification, illustrate the preferred embodiments of the present invention, and together with the descriptions serve to explain the principles of the invention.

In the Drawings.

DETAILED DESCRIPTION OF THE PREFERRED EMBODIMENTS

Figure 1:
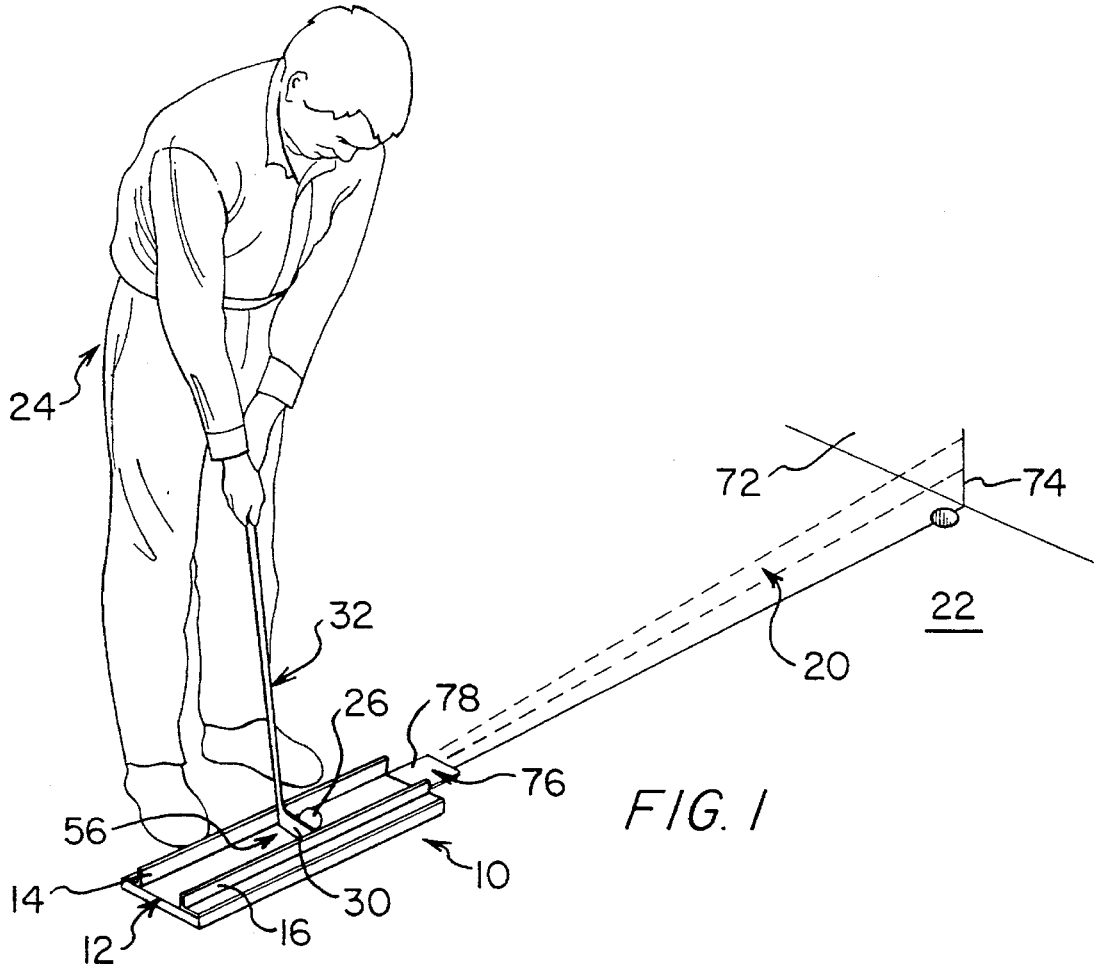
FIG. 1 is an isometric view of the golf training device of the present invention shown with a golfer holding a putter and addressing a golf bail on top of the device. The device is seen to project a visible beam of light in the shape of a substantially vertically-oriented plane which forms a visible horizontal line on the ground and a visible vertical line on an optional vertical target behind the golf hole.
Figure 4:
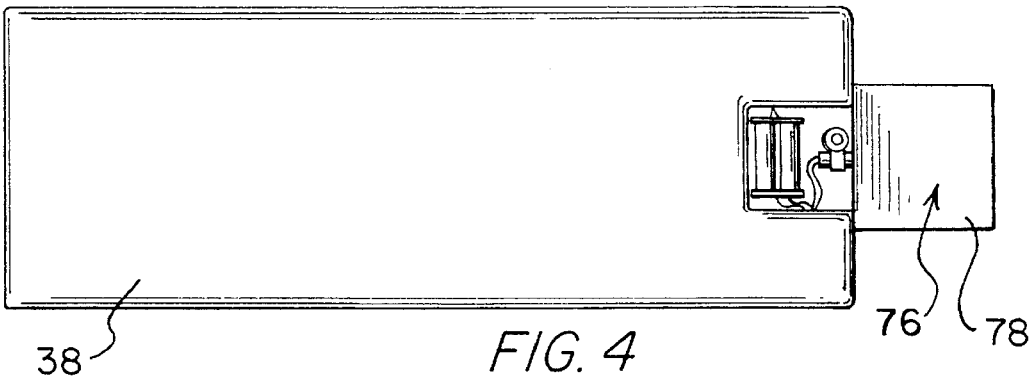
FIG. 4 is a bottom view of the golf training device shown in FIG. 1.
Figure 8:
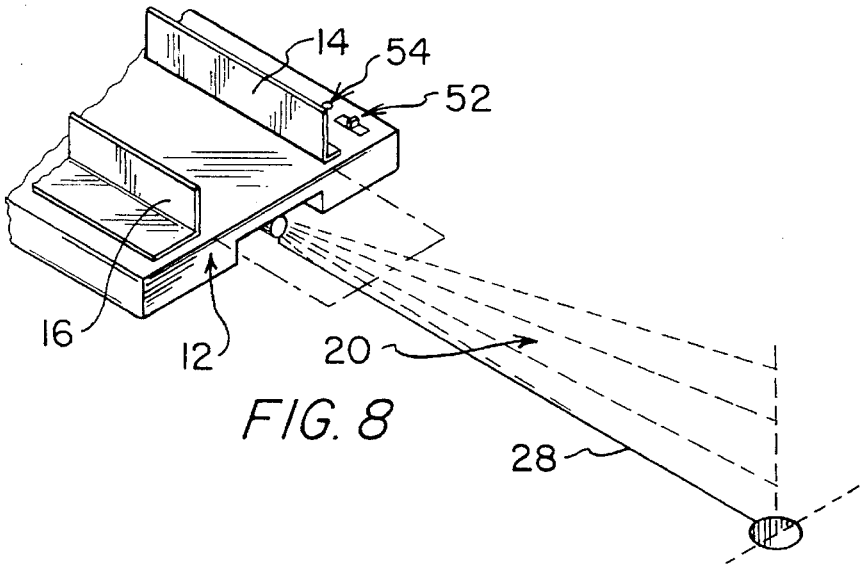
FIG. 8 is a partial isometric view of the golf training device showing the planar-shaped beam of light projected from the light source located in the hollow recess of the support base and forming a horizontal line on the ground in front of the golf training device.

The golf putting trainer or golf training device 10 of the present invention shown in FIG. 1 includes a support base 12, a pair of guide rails 14 and 16 removably attached to the support base 12, and a light source 18 (FIGS. 4 and 5) and associated electrical circuit for projecting a light beam 20 forward of the support base 12. The support base 12 is intended to be laid on the ground 22, typically a carpeted surface or a putting green, as shown in FIGS. 1 and 8. A golfer 24 can place a golf ball 26 on top of the support base 12 and attempt to putt the ball 26 along a target line 28 created by the light source 18. The guide rails 14 and 16 serve to "guide" the club head 30 of the golfer's golf club, or putter 32, during the stroke to help insure an accurate stroke.

Figure 3:
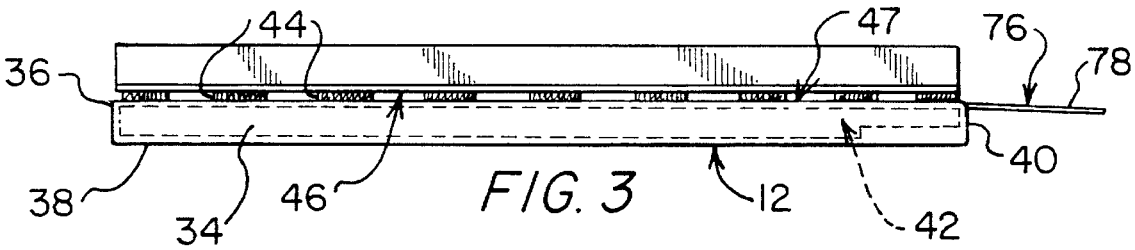
FIG. 3 is a side view of the golf training device shown in FIG. 1.

As shown in FIG. 3, the support base 12 includes a board 34 which may be composed of any suitable stiff material such as wood, plastic or foam. The board 34 is covered with carpet 36 or other material which provides a surface suitable for putting the golf ball 26 thereon. The bottom side 38 of the board 34 may or may not be covered by the carpet 36. At the intersection of the bottom side 38 of the board 34 and a front face 40 of the board 34, a hollow recess 42 is defined. This hollow, box-shaped recess 42 accommodates and receives the light source 18 and the associated electrical circuit.

Each of the pair of guide rails 14 and 16 is an elongated strip of plastic, which is L-shaped in cross section (FIGS. 1, 2, 3, and 8). Alternatively, the guide rails 14 and 16 could be composed of any other suitable material. A plurality of releasable connectors 44 (FIG. 3) are provided on a bottom surface 46 of each of the guide rails 14 and 16 for mating with corresponding connectors on the support base 12. Each corresponding connector on the support base 12 could be a strip of mating material, but instead preferably is the carpeted surface 36 covering a top side 47 of the board 34. The releasable connectors 44 are of the commonly-known pile and loop variety.

Figure 2:
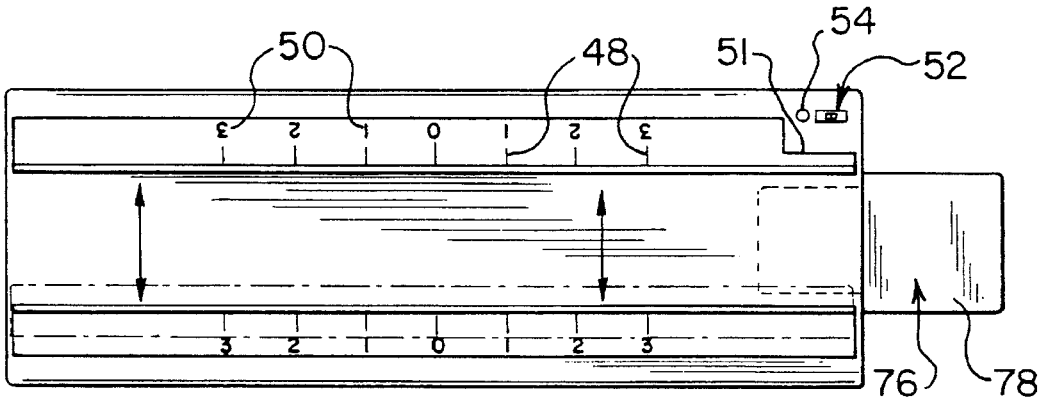
FIG. 2 is a top view of the golf training device shown in FIG. 1.

Each of the guide rails 14 and 16 is provided with distance markings 48 and numerical indicia 50 on the guide rail, as shown in FIG. 2. The markings 48 and indicia 50 indicate a zero or center point where the ball 26 is preferably located and are sequentially numbered extending in either direction from the center point. These indicia 50 allow the golfer 24 to practice taking the club head 30 back away from the bail 26 (the back-stroke) a distance approximately the same as the distance the club head 30 travels past the ball 26 after impact (the forward-stroke). Such a putting motion is consistent with the pendulum-type putting stroke which is recommended and practiced by many golf professionals. One of the guide rails 14 is notched at an end thereof to define a notch 51 to provide room on the top side 47 of the support base 12 for an on/off switch 52 and an LED 54 which indicates the operational status of the light source 18.

Because of the releasable nature of the guide rails 14 and 16 to the support base 12, the guide rails can be repositioned at any desired location on the support base. It may be desirable to position the guide rails 14 and 16 with a spacing corresponding to or just larger than the length of the club head 30 of the golfer's putter 32. This allows the golfer 24 to swing or stroke the putter 32 through a channel or guide path 56 created by the guide rails 14 and 16 in a straight-back and straight-through manner. Any side-to-side motion in the back-stroke or forward-stroke will cause the club head 30 to contact one or both of the guide rails 14 and 16 and will be sensed by the golfer 24. In this manner the golfer 24 can continuously practice the putting stroke until the club head 30 does not contact the guide rails 14 and 16. Thus, the golfer 24 can groove a smooth and consistent putting stroke which has little side-to-side movement. Further, it may be desirable to gradually spread the guide rails 14 and 16 further and further from this initial position so that the golfer 24 may practice the putting stroke without being dependent on the guide rails to make a smooth and consistent stroke. It can be appreciated that this construction also accommodates a variety of putters (not shown) having club heads with different lengths.

Figure 5:
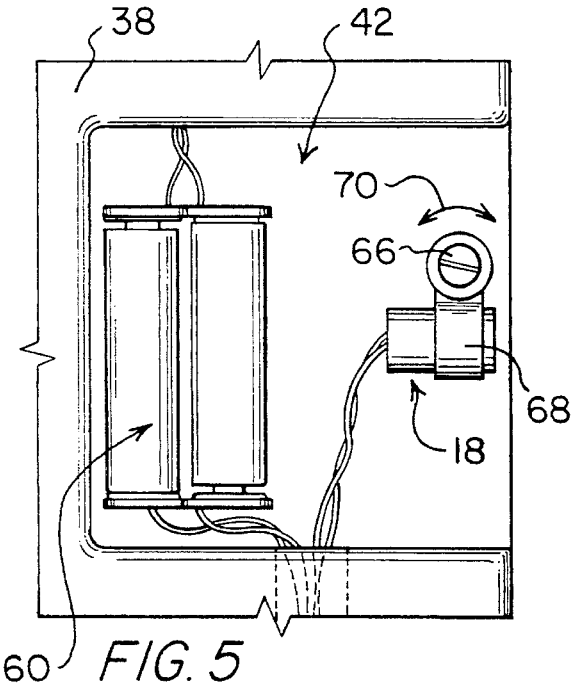
FIG. 5 is an enlarged view of a portion of the bottom view shown in FIG. 4, showing a hollow recess in the bottom surface of the golf training device and the connection of a light source and related components therein.
Figure 6:
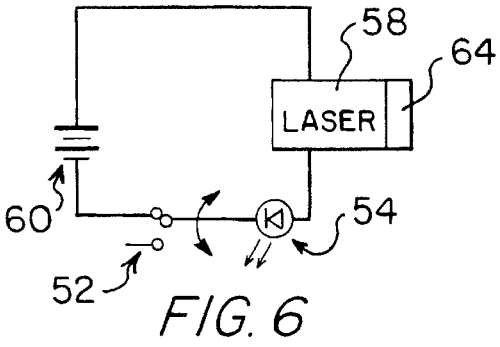
FIG. 6 is a schematic diagram of the electrical circuit which controls the laser light source in the golf training device shown in FIG. 1.
Figure 7:
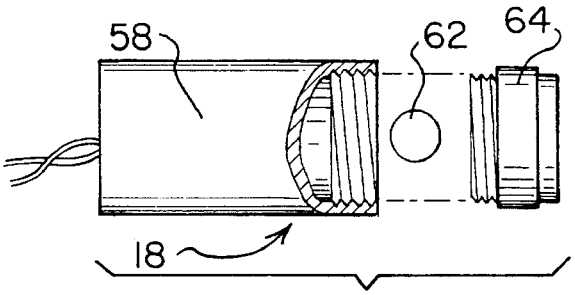
FIG. 7 is an enlarged exploded view of the laser light source which is shown in FIG. 5.

As shown in FIGS. 5 and 7, the light source 18 and associated circuit include a laser 58, a battery 60, the on/off switch 52, and the LED 54 for indicating the operational status of the light source 18. The laser 58 and the battery 60 are located in the hollow recess 42 defined in the bottom side 38 and front face 40 of the support base 12, as shown in FIG. 5. The on/off switch 52 and the LED 54 are located on the top surface 47 of the support base 12 in the area corresponding to the previously-described notch 51 on one of the guide rails 14, as shown in FIG. 2. A schematic diagram of the electrical circuit powering the laser 58 is shown in FIG. 6.

The laser 58 currently used is supplied by Lyte Optronics of Santa Monica, Calif., as Model No. TAZ (670 nanometers). The laser 58 is a semiconductor (InGaAlP) diode laser, operating in the Class IIIa range at up to 5 milliwatts. The unmodified beam (not shown) emitted by the laser 58 is a narrow substantially cylindrical beam. Optionally, the Lyte Optronics TAZ laser could be supplied in a configuration to emit a beam at a wavelength of 635 nanometers to provide a brighter beam for predominantly outdoor use. Another supplier of a similar laser is Metrologic Instruments, Inc. of Bellmawr, N.J., as Model No. 45200. Instead of a laser 58, another light source which provides a bright, beam-shaped output could be used, such as certain LEDs.

The narrow, cylindrical beam is modified by an optical element, or lens 62 (FIG. 7), which is positioned at the output of the laser 58 and held in place by a screwcap 64 connectable to the laser. The lens 62 is a shortened cylindrical rod which is placed transversely to the laser beam emitted by the laser 58. The lens 62 serves to convert the narrow, cylindrical beam into the fan-shaped or planar-shaped beam 20. The orientation of the plane will vary depending upon the orientation of the lens 62 relative to the beam from the laser 58. In the configuration shown in FIG. 7, the fan-shaped beam 20 emitted by the light source 18 made up of the laser 58 and lens 62 will lie in the plane defined by the paper. Thus, when the lens 62 is positioned horizontally within the space between the laser 58 and the screw cap 64, the vertically-oriented planar beam 20 is created.

The light source 18, made up of the laser 58 and the lens 62, is attached to the support base 12 by a screw 66 which serves to damp a sleeve 68 within the hollow recess 42, as shown in FIG. 5. The laser 58 is slidably received within the sleeve 68 and held therein. The alignment of the laser 58 can be adjusted by loosening the screw 66 slightly so that the sleeve 68 can be rotated about a vertical axis, namely the longitudinal axis of the screw, in the direction shown by the arrow 70 in FIG. 5. When the sleeve 68 and laser 58 are thus adjusted, the azimuthal alignment or direction of the beam 20 can be controlled. In this manner, the beam 20 can be fine-tuned to project directly forward from the support base 12 and parallel to the longitudinal axis of the guide rails 14 and 16 as described above.

The battery 60 is also contained within the hollow recess 42 defined in the support base 12. The battery 60 includes a pair of AA batteries connected in series and wired to the switch 52 and LED 54 located on the top side 47 of the support base 12. The switch 52 is preferably a single-pole, double-throw switch. The LED 54 may be any type of LED which produces relatively low-power, diffuse light.

Thus, it can be appreciated that the light source 18 can be turned on and off as desired with the switch 52. Further, when the device 10 is placed on the ground 22 which may include carpet, a putting green, or any other horizontal surface, the target line 28 is formed by the intersection of the planar-shaped beam 20 with the ground 22. Further, if there is a remote vertical object 72 such as a wall, if used indoors, or an optional board or any other object if used on a putting green (see FIG. 1), the planar-shaped beam 20 will form a vertical line 74 on the vertical surface.

An optional ramp 76 may be utilized to provide a smooth transition from the top side 47 of the support base 12 to the ground 22. As shown in FIGS. 1, 2, 3, and 8, the ramp 76 includes an elongated, resilient flap 78 which is attached to the support base 12 and extends out from the intersection of the top side 47 of the support base 12 and the front face 40 of the support base. The attachment of the flap 78 to the support base 12 is above the recess 42 which holds the light source 18. The resilient nature of the ramp 76 is such that at a rest position the ramp is substantially horizontal and extends straight out from the support base 12. Under the weight of the golf ball 26, the flap 78 deforms to form the ramp 76 down to the ground. In this position, also known as the stressed position, the ramp 76 preferably forms an angle of less than 45° from the horizontal. Alternatively, a non-deformable fixed ramp (not shown) could be provided.

In operation and use, the device 10 can be placed directly on the ground 22 such as a carpet or a green. When the light source 18 is turned on with the switch 52, the target line 28 is formed on the ground 22 and a vertical line 74 is formed on a remote vertical object 72, if any. The golf ball 26 may be placed on top of the support base 12 and the golfer 24 can get into position to putt the ball along the target line 28. When assuming this position, the golfer 24 can take care to seek any desired alignment of the feet, hips, shoulders and/or any other portion of the body with the target line 28. Further, the golfer 24 can align the club head 30 of the putter 32 with the target line. In many cases, modem putters include markings or indicia (not shown) on the surface thereof for alignment with the target line 28. Also, the target line 28 can be used by the golfer 24 to provide a mental image of the ball's path in an attempt to swing or stroke the putter 32 to roll the ball 26 along the target line. Further, the guide rails 14 and 16 may be positioned closely to the club head 30 so as to assist the golfer 24 to stroke along the target line 28.

After the golfer 24 strokes or putts the ball 26, an on-line putt can be seen to roll along the target line 28 and a vertical line (not shown) will be seen on the back of the golf ball. If the golf ball 26 is slightly off-line, the vertical line will appear off-center on the golf ball. Otherwise, if the golf ball 26 is further off-line, no vertical line will be seen on the golf ball and the ball's path can be compared to the target line 28 on the ground 22. Assuming a flat, smooth surface, the two factors which will cause a putt to be off line will be a misalignment of the face of the club head 30 with the target line 28 at impact and a swing path at impact which is misaligned from the target line. If the guide rails 14 and 16 are tightly positioned adjacent the club head 30 of the putter 32, then an off-line putt will be due to misalignment of the club head at impact. This is because the swing path cannot be misaligned when the guide rails 14 and 16 tightly constrain the swing path.

Of course, it can be appreciated that the present invention could be practiced either with or without the guide rails 14 and 16 in position. Similarly, the present invention could be practiced with or without the light source 18 since the guide rails 14 and 16 could provide a swing path training device. Also, the present invention could be practiced with or without the optional ramp 76 since the discontinuity from the support base 12 to the ground 22 has not been found to significantly alter the golf ball's path. Further, the present invention could be practiced with or without the lens 62 which creates the planar-shaped beam 20. The narrow, cylindrical laser beam could be used to create a substantially circular spot (not shown) on a remote vertical object or even an elongated spot on the ground 22. Further, if impurities are in the air such as smoke, dirt, steam, mist, etc., then the laser beam will be visible as a cylindrical or planar-shaped beam through the air.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

The embodiments of the invention in which an exclusive property or privilege is claimed are defined as follows:

1. A golf training device for a golfer to utilize in practicing the stroke of a golf club in order to attempt to accurately hit a golf ball toward a remote target, the device comprising:

a support base adapted for resting on the ground and including a top surface from which a golf ball may be putted; and a laser light source associated with the support base, the laser light source generating a visible beam of high-intensity light forward of the support board and toward the remote target to create a visible spot of high-intensity light on the target, wherein the golfer can appreciate the alignment of the golfer's body and of the golf club relative to the remote target by viewing the visible beam of light and the visible spot of high-intensity light on the target while putting the golf ball to said target from the top surface of said support base.

2. A golf training device as defined in claim 1, further including a pair of elongated guide rails attached to the support base to receive a golf club therebetween and on top of the support base when the golfer practices by stroking the golf club between the guide rails of the training device.

3. A golf training device as defined in claim 2, wherein the guide rails are removably attached to the support base.

4. A golf training device as defined in claim 3, wherein the removable attachment is achieved with releasable pile and loop connectors.

5. A golf training device as defined in claim 4, wherein the guide rails can be selectively positioned at any of a plurality of spaced-apart positions relative to each other.

6. A golf training device as defined in claim 2, wherein at least one of the guide rails includes markings thereon for indicating a scale of relative distance, the markings being visible to the golfer to allow the golfer to make a back-stroke and forward-stroke of the golf club which are of a predetermined length.

7. A golf training device as defined in claim 2, wherein the support base includes a board.

8. A golf training device as defined in claim 7, wherein the board includes a front face in which an opening is defined for receiving the laser light source.

9. A golf training device as defined in claim 7, further including a ramp formed on the support base to provide a gradual transition from the top of the support base to the ground to provide a gradual pathway for a golf ball to roll therealong.

10. A golf training device as defined in claim 9, wherein the board includes a front face in which an opening is defined for receiving the laser light source.

11. A golf training device as defined in claim 2, wherein the laser light source is associated with the support base in such a position relative to the top of the support base that a golf ball placed on top of the support base will not obstruct the beam of light from forming the spot of high-intensity light on the remote target.

12. A golf training device as defined in claim 2, wherein the laser light source is connected to the support base by an adjustable connection to allow the relative alignment of the visible beam of light to the support base to be adjusted.

13. A golf training device as defined in claim 12, wherein the adjustable connection is a pivotal connection.

14. A golf training device as defined in claim 13, wherein the pivotal connection is adapted to pivot about a vertical axis to allow an azimuthal adjustment of the relative alignment of the visible beam of light to the support base.

15. A golf training device as defined in claim 14, wherein the pivotal connection includes a sleeve for receiving the laser light source, and an adjustable screw connected to the support base for retaining the sleeve thereon.

16. A golf training device as defined in claim 1, further including:

a pair of guide rails attached to the support base to provide a guide path for the golfer to stroke the golf club along, at least one of the rails being removably attachable to the support base to allow the rails to be placed in a variety of spaced-apart positions relative to each other;

wherein the support base includes a board having a front face in which an opening is defined to receive the light source;

wherein the light source includes a laser and a cylindrical lens positioned transversely to the light beam, the lens creating a planar-shaped, vertically-oriented beam which forms a target line on the ground at its intersection with the ground; and wherein the light source is connected to the support base by an adjustable connection which is pivotal about a vertical axis to allow the relative azimuthal alignment of the visible beam of light to the support base to be adjusted.

17. A golf training device as defined in claim 16, further including a ramp for allowing the golf ball to roll therealong down from the support base to the ground.

18. A golf training device for a golfer to utilize in practicing the stroke of a golf club in order to attempt to accurately hit a golf ball toward a remote target, the device comprising:

a support base adapted for resting on the ground, the support base having a top surface thereon from which a golf ball may be putted toward said target;

a laser light source associated with the support base, the laser light source generating a visible beam of high-intensity light forward of the support board and toward the remote target to create a visible spot of high-intensity light on the target, wherein the laser light source is associated with the support base in such a position relative to the top of the support base that a golf ball placed on the top surface of the support base will not obstruct the beam of light from forming the spot of high-intensity light on the remote target, wherein the golfer can appreciate the alignment of the golfer's body and of the golf club relative to the remote target by viewing the visible beam of light and the visible spot of high-intensity light on the target; and a pair of elongated guide rails attached to the support base to receive a golf club therebetween and on the top surface of the support base when the golfer practices by stroking the golf club between the guide rails of the training device.

19. A golf training device as defined in claim 18, wherein the support base has a front end and wherein the laser light source is received within the support base in an orientation to allow the visible beam of high-intensity light to project forward of the support base on a line which is substantially parallel to a plane in which the top surface of the support base lies, the line being vertically offset from and below the plane.

* * * * *